US011834310B2

(12) United States Patent
Reis et al.

(10) Patent No.: US 11,834,310 B2
(45) Date of Patent: Dec. 5, 2023

(54) CARRYING DEVICE AND METHOD FOR FRONTAL REMOVAL OF A ROLL BODY FROM A ROLL FRAME, AND ROLL FRAME HAVING A ROLL BODY WHICH CAN BE REMOVED FRONTALLY

(71) Applicant: BÜHLER AG, Uzwil (CH)

(72) Inventors: Pascal Reis, Hefenhofen (CH); Hermann Buerke, Uzwil (CH); Oliver Schneider, St. Gallen (CH); Cyril Brändli, Schlatt bei Winterthur (CH); Sebastian Wels, Kreuzlingen (CH)

(73) Assignee: Bühler AG, Uzwil (CH)

( * ) Notice: Subject to any disclaimer, the term of this patent is extended or adjusted under 35 U.S.C. 154(b) by 183 days.

(21) Appl. No.: 16/072,670

(22) PCT Filed: Jan. 27, 2017

(86) PCT No.: PCT/EP2017/051806
§ 371 (c)(1),
(2) Date: Aug. 1, 2018

(87) PCT Pub. No.: WO2017/129764
PCT Pub. Date: Aug. 3, 2017

(65) Prior Publication Data

US 2019/0119082 A1 Apr. 25, 2019

(30) Foreign Application Priority Data

Jan. 27, 2016 (EP) ..... 16153028
May 23, 2016 (EP) ..... 16170918

(51) Int. Cl.
*B66F 5/02* (2006.01)
*B02C 4/28* (2006.01)
(Continued)

(52) U.S. Cl.
CPC ..... *B66F 5/025* (2013.01); *B02C 4/02* (2013.01); *B02C 4/28* (2013.01); *B02C 4/30* (2013.01)

(58) Field of Classification Search
CPC ..... B23P 19/002
(Continued)

(56) References Cited

U.S. PATENT DOCUMENTS 3,067,884 A * 12/1962 Williams ..... F41A 9/87 414/497
4,630,781 A * 12/1986 Brown, Jr. ..... B02C 4/08 241/159
(Continued)

FOREIGN PATENT DOCUMENTS

DE 10 2011 121 495 B3 5/2013
EP 2 662 143 A2 11/2013
(Continued)

OTHER PUBLICATIONS

European Search Report Corresponding to 16170918.3 dated Nov. 9, 2016.
(Continued)

*Primary Examiner* — Ronald P Jarrett
(74) *Attorney, Agent, or Firm* — Finch & Maloney PLLC

(57) ABSTRACT

A carrying device (1) for the frontal removal of a roll body from a roll frame, comprising a main frame (2) and a receiving section (3) for the roll body. The receiving section (3) can be transferred from an introduction position (E) into a supporting position (S). The receiving section (3) has a profile which at least partially encloses the roll body in the supporting position (S), and the carrying device (1) can be pushed in below the roll body with the receiving section (3) in the introduction position (E), and the roll body is carried with the receiving section (3) in the supporting position (S).

17 Claims, 6 Drawing Sheets

(51) Int. Cl.
*B02C 4/02* (2006.01)
*B02C 4/30* (2006.01)

(58) Field of Classification Search
USPC ..... 414/911
See application file for complete search history.

(56) References Cited

U.S. PATENT DOCUMENTS

| | | | | |
|---|---|---|---|---|
| 7,198,452 | B2 * | 4/2007 | Kirykowicz | B23Q 7/001 198/346.2 |
| 2001/0015425 | A1 * | 8/2001 | Garceau | B66F 3/12 254/126 |

FOREIGN PATENT DOCUMENTS

| | | | |
|---|---|---|---|
| WO | WO 89/04719 | * | 6/1989 |
| WO | 2005/102531 | A1 | 11/2005 |

OTHER PUBLICATIONS

International Search Report Corresponding to PCT/EP2017/051806 dated Mar. 29, 2017.
Written Opinion Corresponding to PCT/EP2017/051806 dated Mar. 29, 2017.

* cited by examiner

CARRYING DEVICE AND METHOD FOR FRONTAL REMOVAL OF A ROLL BODY FROM A ROLL FRAME, AND ROLL FRAME HAVING A ROLL BODY WHICH CAN BE REMOVED FRONTALLY

This application is a National Stage completion of PCT/EP2017/051806 filed Jan. 27, 2017, which claims priority from European patent application serial no. 16153028.2 filed Jan. 27, 2016.

FIELD OF THE INVENTION

The invention relates to a carrying device for frontal removal of a roll body from a roller mill, a roller mill having a roll body which can be removed frontally, as well as a method for frontal removal of a roll body from a roller mill.

BACKGROUND OF THE INVENTION

At present, various solutions are known for the removal of rolls from a roller mill, which are not entirely satisfactory.

The roll can be removed together with the roll stubs. In this case, all parts attached to the roll stubs such as belt wheels and couplings for transmission gearing or direct drive must be removed before the roll is removed by crane or by apparatus from the roller mill. The roller mill needs to be designed such that the roll can be removed with the roll stubs. Possibly further components need to be removed from the roller mill. The roll is generally replaced entirely, which is very cost and time intensive.

The roll can also be removed together with the roll stubs as well as the adjustment and bearing mechanism. In this case, all parts attached to the roll stubs such as belt wheels and couplings for transmission gearing or direct drive must be removed before the roll is removed by crane or by apparatus from the roller mill. The roller mill needs to be designed such that the roll can be removed with the roll stubs. Possibly further components need to be removed from the roller mill. The roll is generally replaced entirely, which is very cost and time intensive.

In order to avoid the above mentioned drawbacks, WO 2005/102531 A1 proposes removing only the roll shell. In this case, the roll stubs are moved apart from each other and the roll shell is lifted and removed from the roller mill. The roll or the roll shell must be accessible from above in this case. This is not possible in all roller mills, especially when several grinding stages are present one above another. Moreover, the feeding of the roller mill also often occurs from above. In such a case, it is also necessary at first to remove any such components. Furthermore, such a solution is only suitable for single-stage roller mills with rolls of smaller dimensions (diameter up to 25 cm and length up to 1 m).

SUMMARY OF THE INVENTION

Therefore, the problem which the invention proposes to solve is to indicate a device of the kind mentioned above which avoids the advantages of the prior art and in particular allows an uncomplicated, time and cost saving removal of a roll body even in the case of multistaged roller mills.

The problem is solved by a carrying device according to the independent claim.

The carrying device according to the invention comprises a main frame and a receiving section for the roll body, which can be moved from an introduction position into a supporting position. The receiving section in this case has a profile which encloses the roll body at least partly in the supporting position. The carrying device can be inserted beneath the roll body with the receiving section in the introduction position, while the roll body is supported with the receiving section in the supporting position.

A "frontal removal" of a roll body in the sense of the present invention means that the roll body apart from tolerable deviations can be removed substantially perpendicular to the plumb-line (horizontally) from a roller mill.

In the sense of the present invention, by a "profile of the receiving section which encloses the roll body at least partly" is meant a profile in which a rolling off of the roll body is prevented with the receiving section in the supporting position. The receiving section may be configured such that in the supporting position the roll body is supported at least at two bearing points, which are situated radially with respect to the roll body on either side of a vertical line extending through the axis of the roll body. In other words, the at least two bearing points must be situated higher than the lowest point of the roll body (outermost radial dimension in the vertical direction). If the roll body should have an imbalance, this should be taken into account for the center of gravity. The bearing points may be fashioned for example as two rods, which when used as intended extend parallel to the roll axis. The receiving section may also have a profile which forms a recess to receive the roll body in the supporting position. The shape or the profile of the recess need not correspond to the curvature of the roll body. For example, it is possible for the receiving section to allow a receiving of roll bodies of different diameter. It may happen that roll bodies with a small diameter have play when the receiving section is situated in the supporting position and the roll body is being carried. The only important thing here is that the receiving section encloses the roll body such that the roll body cannot unintentionally leave the receiving section, such as due to vibrations or inertia during the removal process.

Preferably, the height difference between bearing points and lowest point of the roll body in the vertical direction is more than 5% of the roll body diameter, further preferably more than 25% of the roll body diameter and especially preferably between 25% and 40% of the roll body diameter.

Preferably, the receiving section may have a profile with a radius of curvature which can be larger than the radius of curvature of the roll body.

Further preferably, the receiving section has a profile with a curvature which corresponds to the curvature of the roll body. In this way, the weight can be distributed over the entire contact surface of the receiving section. This prevents damage to the roll surface, in particular. Moreover, such a profile enables an automatic centering and positioning of the carrying device when the receiving section is moved from the introduction position into the supporting position.

Preferably, the main frame has a substantially L-shaped form with two legs standing at an angle to each other, wherein the receiving section is pivot-mounted in an end region of one leg, preferably the shorter leg.

This preferred embodiment is especially easy to fabricate, since the receiving section is pivot-mounted on the main frame and its guiding is not complicated.

Preferably, one leg, preferably the longer leg, has guiding means, preferably configured as rollers. The guiding means serve for guiding the carrying device when the carrying device is shoved in underneath the roll and are preferably configured complementary to further guiding means of the roller mill. Preferably, this is accomplished by rollers, which cooperate with a suitably designed guide rail of the roller mill.

Preferably, the receiving section can move by actuating means between the introduction position and the supporting position. Even though a manual transfer of the receiving section is possible, the actuating means preferably comprise mechanical, hydraulic or pneumatic actuating means on account of the weight of the roll body. Besides the above mentioned possibility of swiveling the receiving section, other configurations are conceivable in this context, such as a scissor joint, a vertical guiding of the receiving section, and so forth. Preferably, the actuating means are designed such that when the roll body is resting on the receiving section, a self-locking of the actuating means occurs.

The actuating means preferably comprise a threaded rod. Such a configuration can be fabricated in an especially cost-favorable manner, and it can also be manually actuated and is self-locking, if the thread pitch is properly dimensioned.

The threaded rod is preferably mounted in a threaded bushing, wherein the threaded bushing is mounted in the same leg of the main frame as the receiving section. In this preferred embodiment, the threaded bushing acts as an abutment when actuating the threaded rod and it absorbs any axial force produced.

The threaded rod is preferably connected at one end to an expanding joint in a way that is rotatable, yet firm against pushing and pulling, wherein the expanding joint is expandable by rotating of the threaded rod and the receiving section can be moved from the introduction position into the supporting position. An axial force—with respect to the axis of the threaded rod—is created by turning the threaded rod. Since the threaded bushing is received as an abutment in the main frame, the axial force brings about the spreading of the expanding joint, after which the receiving section is moved and moved from the introduction position into the supporting position.

The expanding joint preferably comprises three joint segments arranged about a common pivot axis, wherein a first joint segment is connected to the threaded rod and the other joint segments are connected pivotably to the main frame and the receiving section, respectively. Hence, by transmission of force from the threaded rod across the first joint segment the other two joint segments are moved apart, after which the receiving section is likewise moved along with them.

Preferably, this occurs by increasing the distance between threaded bushing and the end of the threaded rod which is connected to the expanding joint.

Preferably, the threaded rod is provided with means for accommodating a drive unit. The means may be designed as a seat for a drive shaft, e.g., as a square or a hexagon. The drive unit itself may be, for example, an electric motor, a pneumatic drill or a ratchet whose drive shaft can be inserted into the seat. Alternatively, the seat may also be configured as a threaded nut, so that the threaded rod can be turned with a screw driver or a ratchet with corresponding attachment.

Preferably, means for limiting the swiveling movement of the receiving section are provided. Especially during the transfer of the receiving section into the supporting position it may happen that the receiving section is tensioned too much against the roll surface. Such a tensioning can not only damage the surface of the roll, but also tension the roll body against the roll stub so that a removal is not possible or when the roll stubs are moved apart the roll body is forced upward and drops out from the receiving section.

The invention moreover relates to a roller mill with a plurality of rolls, wherein at least one roll comprises a roll body with two roll stubs, wherein the roll body is releasable by moving apart the two roll stubs from each other.

According to the invention, beneath the at least one roll guiding means for a roll carrying device are arranged, which are or can be arranged beneath the roll such that the roll body can be removed frontally and the roll carrying device is movable in a direction perpendicular to the roll axis.

The roll carrying device is preferably the roll carrying device described above.

The guiding means enable a bracing of the roll carrying device against a frame of the roller mill and a guiding of the roll carrying device along said guiding means, so that no external apparatus such as a crane is needed for the removal of the roll body.

Preferably, the guiding means enable a guiding perpendicular to the plumb-line of the roll carrying device. This ensures that, when the roll body is released, the roll carrying device together with the roll body cannot slide out from the roller mill by gravity in an uncontrolled manner. Alternatively, it is possible for the guiding means to be configured slightly inclined, for example, so that upon releasing the roll body a removal of the roll carrying device by gravity is assisted and simplified. On the other hand, it is conceivable for corresponding inclination of the guiding means to ensure by gravity that the roll carrying device is properly positioned underneath the roll when it is shoved in and that after the releasing of the roll body it prevents an unintentional sliding out of the roll carrying device with the roll body.

Preferably, the guiding means comprise at least one guide rail. The guide rail is complementary in shape to the roll carrying device, so that apart from a tolerable play only a movement of the roll carrying device in a direction perpendicular to the roll axis (and preferably perpendicular to its plumb-line) is possible.

The guiding means are preferably arranged or can be arranged in a product space. By "product space" is meant in the sense of the present invention the space of the roller mill in which the rolls are arranged and have a product passing through them (including a pull-in area and an exit area). The product space is generally separated, preferably sealed off, from other areas of the roller mill by product flow technology.

The invention moreover relates to a method for the frontal removal of a roll body from a roller mill with a plurality of rolls, wherein at least one roll comprises a roll body with two roll stubs and wherein the roll body is releasable by moving apart the two roll stubs from each other, comprising the following steps:

- introducing at least one roll carrying device with a receiving section for the roll body underneath the roll, wherein the at least one roll carrying device is resting on a frame of the roller mill;
- lifting of the receiving section of the at least one roll carrying device such that the roll body is in an operative connection with the roll carrying device and is enclosed at least partially on both sides by the receiving section;
- releasing of the roll body by moving apart the two roll stubs, so that the roll body is resting on the at least one roll carrying device;
- moving the at least one roll carrying device perpendicularly and preferably also perpendicular to the plumb-line of the roll axis.

The method according to the invention is preferably carried out with a device according to the invention.

The carrying out of the method according to the invention has already been described above in regard to the device according to the invention and the roller mill according to the invention, so that benefits and preferred sample embodiments mentioned in this respect are applicable accordingly to the method according to the invention.

BRIEF DESCRIPTION OF THE DRAWINGS

In the following, the invention shall be better described with the aid of a preferred sample embodiment in conjunction with the drawing. There are shown.

DETAILED DESCRIPTION OF THE PREFERRED EMBODIMENTS

Figure 1:
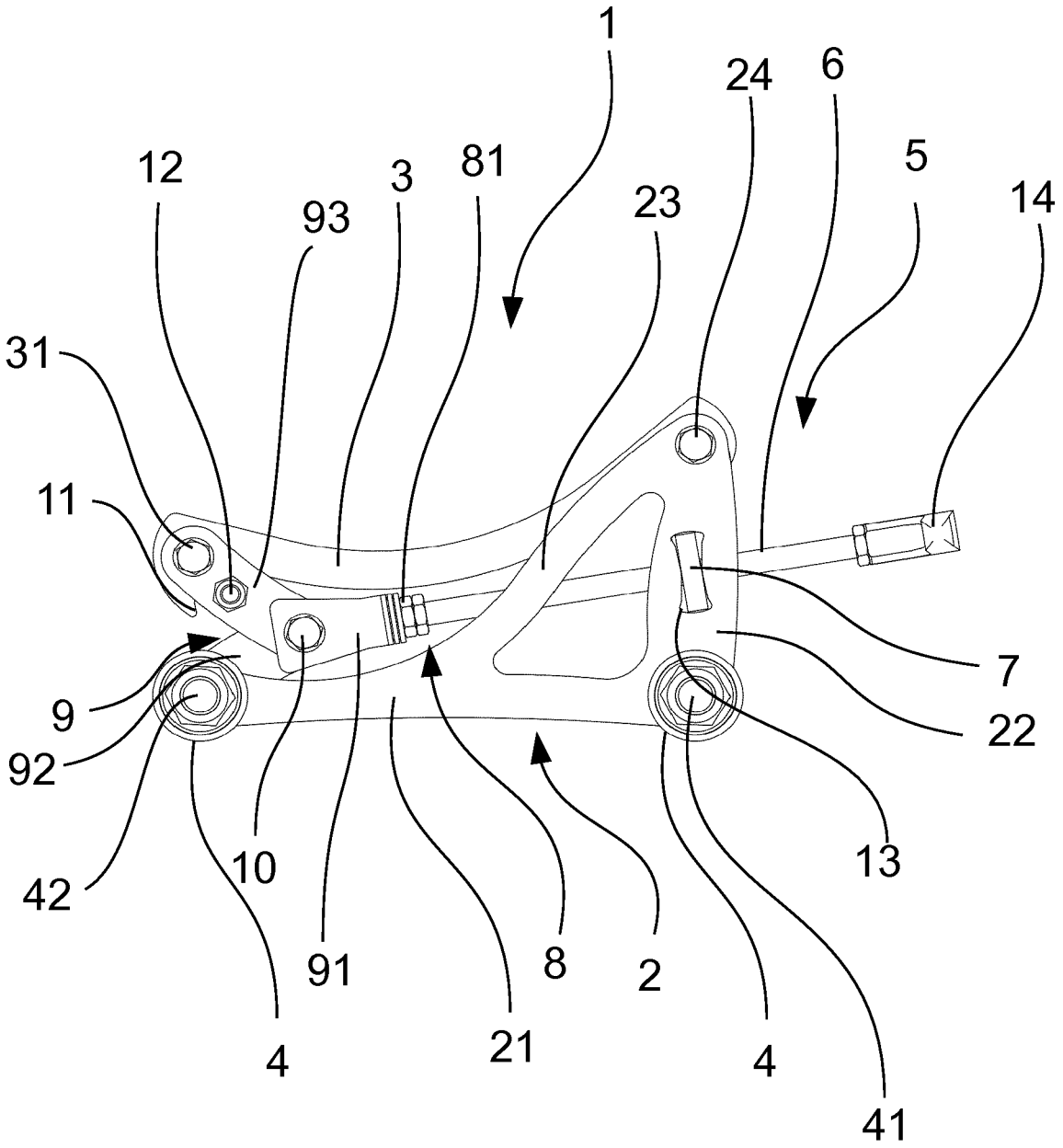
FIG. 1 a preferred embodiment of the roll carrying device according to the invention in an introduction position.
Figure 2:
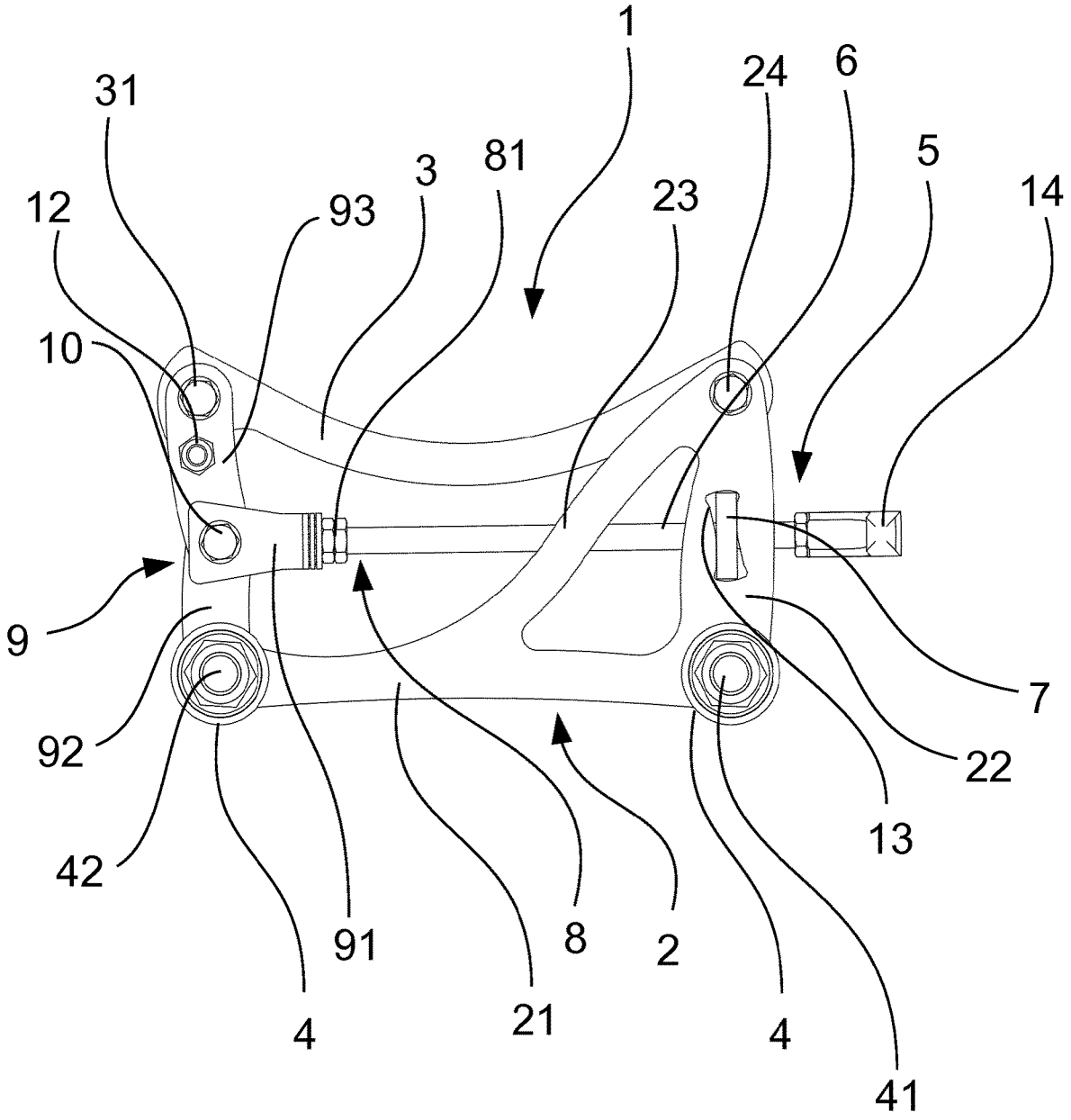
FIG. 2 the roll carrying device of FIG. 1 in the supporting position.

FIGS. 1 and 2 show a roll carrying device, respectively in an introduction position E and a supporting position S, from the side. The roll carrying device of FIG. 2 is shown in perspective in FIG. 3.

The carrying device 1 is assembled from a main frame 2 and a receiving section 3 for the roll.

The main frame 2, looking from the side, has an L-shaped profile with a long leg 21 extending substantially horizontally and a shorter leg 22 extending substantially vertically. A reinforcing strut 23 joins the two legs 21 and 22 and confers stability on the structure. Rollers 4 are arranged at both ends of the leg 21 and thus allow the displacement of the carrying device 1. The roller 4 situated in the area of the connection of the two legs 21 and 22 is supported by the axle 41. The other roller 4, situated at the end of the long leg 21, is supported by an axle 42.

The receiving section 3 has a bent profile and is mounted at the free end of the short leg 22 on a pivot axis 24 and can thus be moved from an introduction position E, in which the free end of the receiving section 3 lies lower than the lowest point of the roll being removed, into a supporting position S in which the roll being removed is supported on both sides against rolling off.

Figure 3:
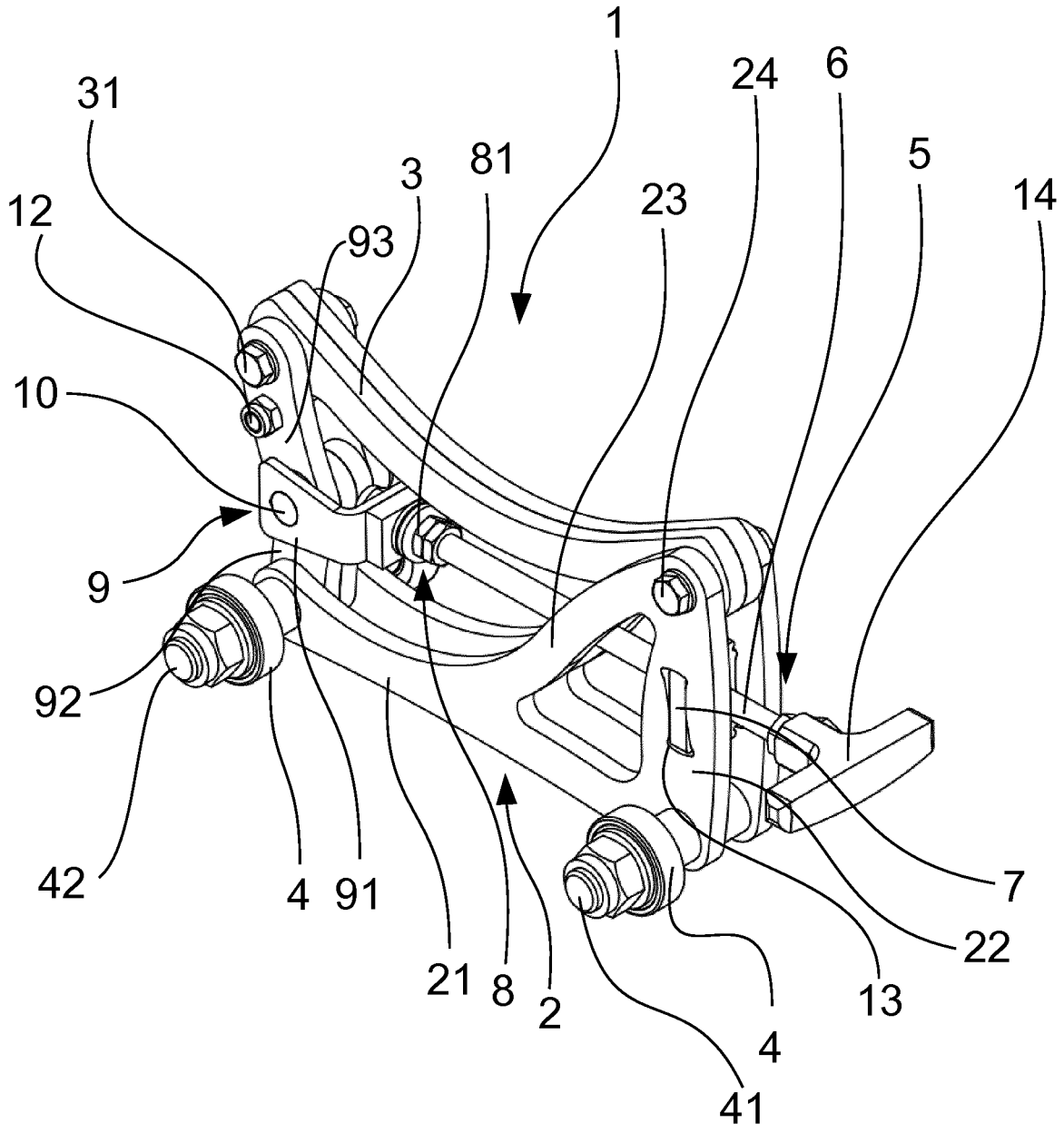
FIG. 3 a perspective view of the roll carrying device of FIG. 2.

As can be seen in FIG. 3, the main frame 2 consists of two mirror-symmetrical parts which are held at a spacing by spacing sleeves, which are respectively placed on the axles 41 and 42. Between the two parts is arranged the receiving section 3, which likewise serves as a spacer.

Means 5 are provided for actuating the carrying device 1, ensuring the secure supporting and displacement of the roll. The means 5 in this preferred sample embodiment comprise a threaded rod 6, which is pivot-mounted in a threaded bushing 7. The threaded bushing 7 is arranged in one cutout 13 of the short leg 22. The cutout 13 enables an axial transmission of forces—with respect to the threaded rod 6—yet it is profiled such that the threaded rod 6 can swivel about an axis perpendicular to the threaded rod axis in order to follow a change in the height position of one end 8 of the threaded rod 6. The other end of the threaded rod 6 is provided with a T-shaped handle 14.

In order to allow the swiveling of the receiving section 3, the end 8 of the threaded rod 6 interacts with an expanding joint 9. The expanding joint 9 in this sample embodiment comprises three joint segments 91, 92 and 93, which are mounted to swivel about a common axle 10. The joint segment 91 is provided with a rotary joint 81, which receives the end 8 of the threaded rod 6, making possible a rotation of the threaded rod 6 and likewise making possible the axial transmission of forces—with respect to the threaded rod axis. The other joint segments 92 and 93 are in operative connection with the support frame 2 and the receiving section 3, respectively. The joint segment 92 is able to swivel about the axle 42. The joint segment 93 is likewise pivot-mounted with the receiving section 3 by the axle 31.

The joint segment 92 also plays the part of a spacer for the main frame 2.

By turning the threaded rod in the corresponding direction of rotation, the spacing between the end 8 of the threaded rod 6 and the threaded bushing 7 can be increased or decreased, after which the receiving section 3 can be raised or lowered. In the area of the axle 31 the receiving section 3 has a projecting lug 11, which together with the receiving section 3 in the supporting position experiences an end stop against a bolt 12 of the joint segment 93 and limits the movement of the receiving section 3.

Figure 4:
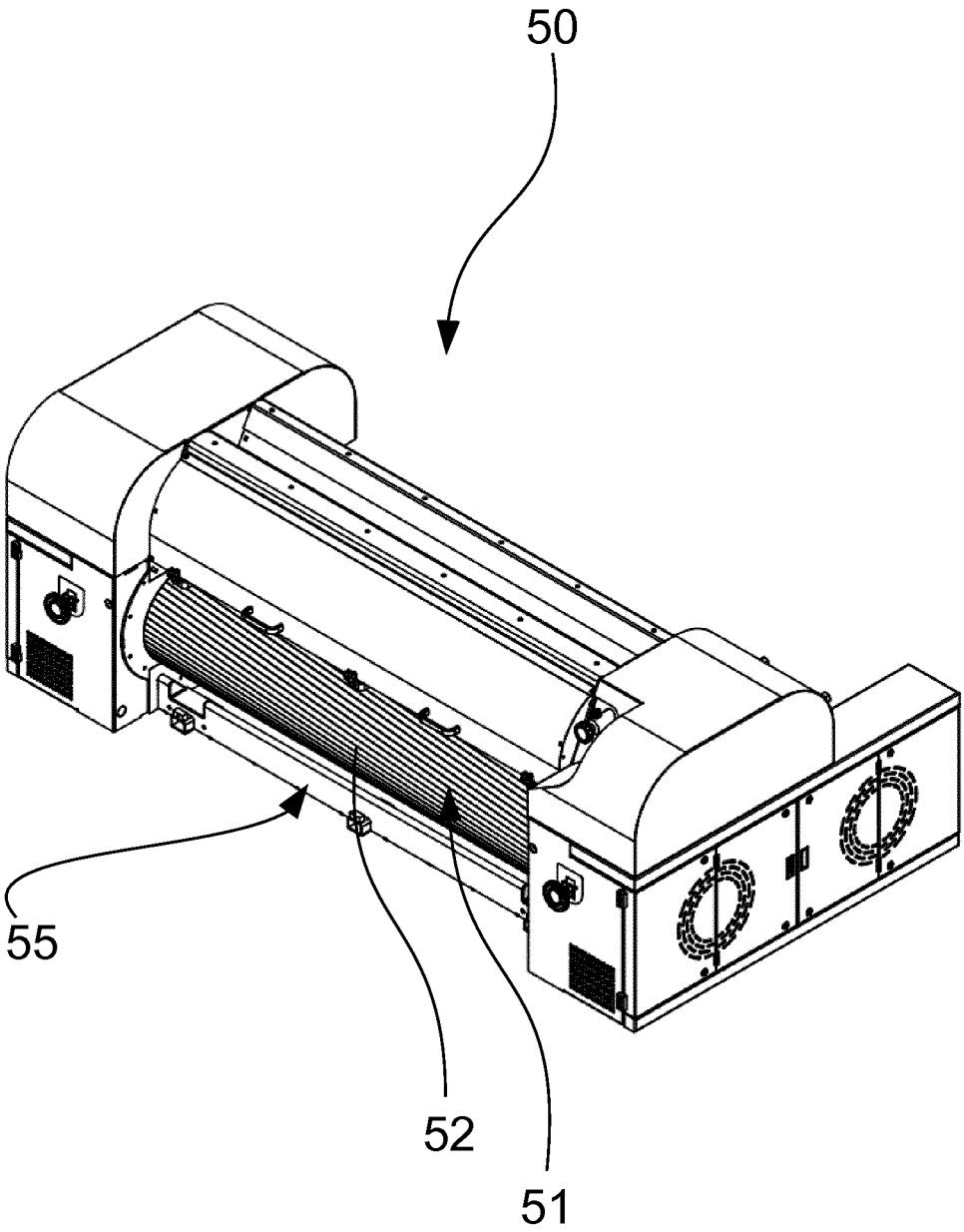
FIG. 4 a perspective view of a roller mill.

FIG. 4 shows schematically a roller mill 50. A roll 51 is indicated by an arrow. The roll 51 (and a roll 51' not visible in FIG. 4) comprises a roll body 52, which is carried by two roll stubs. The roll stubs are configured such that they can be moved apart axially with respect to the roll 51 or 51', so that the roll body 52 is released.

Beneath the rolls 51 and 51', guide rails 53 can be arranged in a product space 55. This can be seen in FIGS. 5 and 6, while FIG. 6 also shows the second roll 51' schematically.

Figure 5:
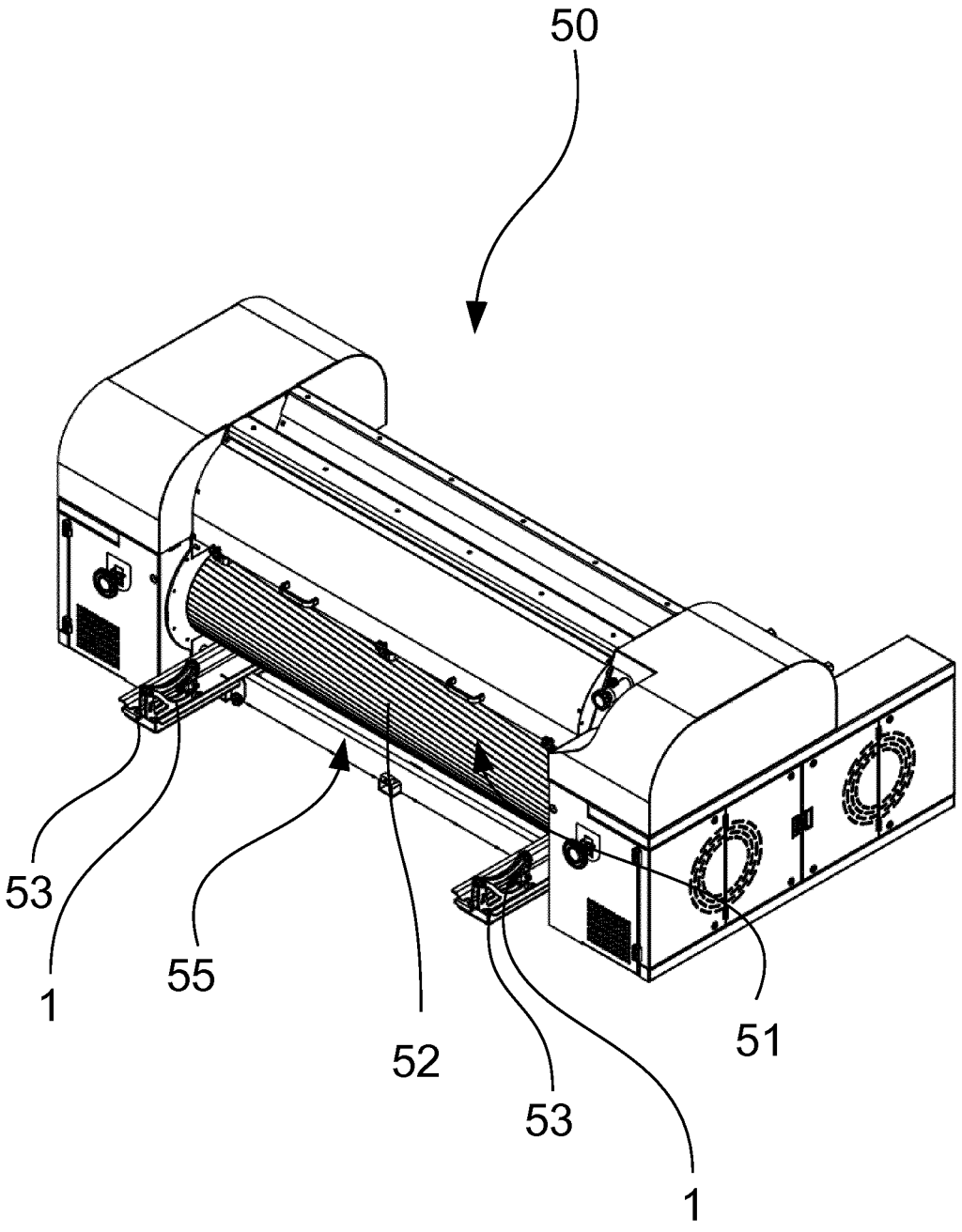
FIG. 5 a perspective view of the roller mill of FIG. 4 with visible rails for the roll carrying device and roll carrying devices.
Figure 6:
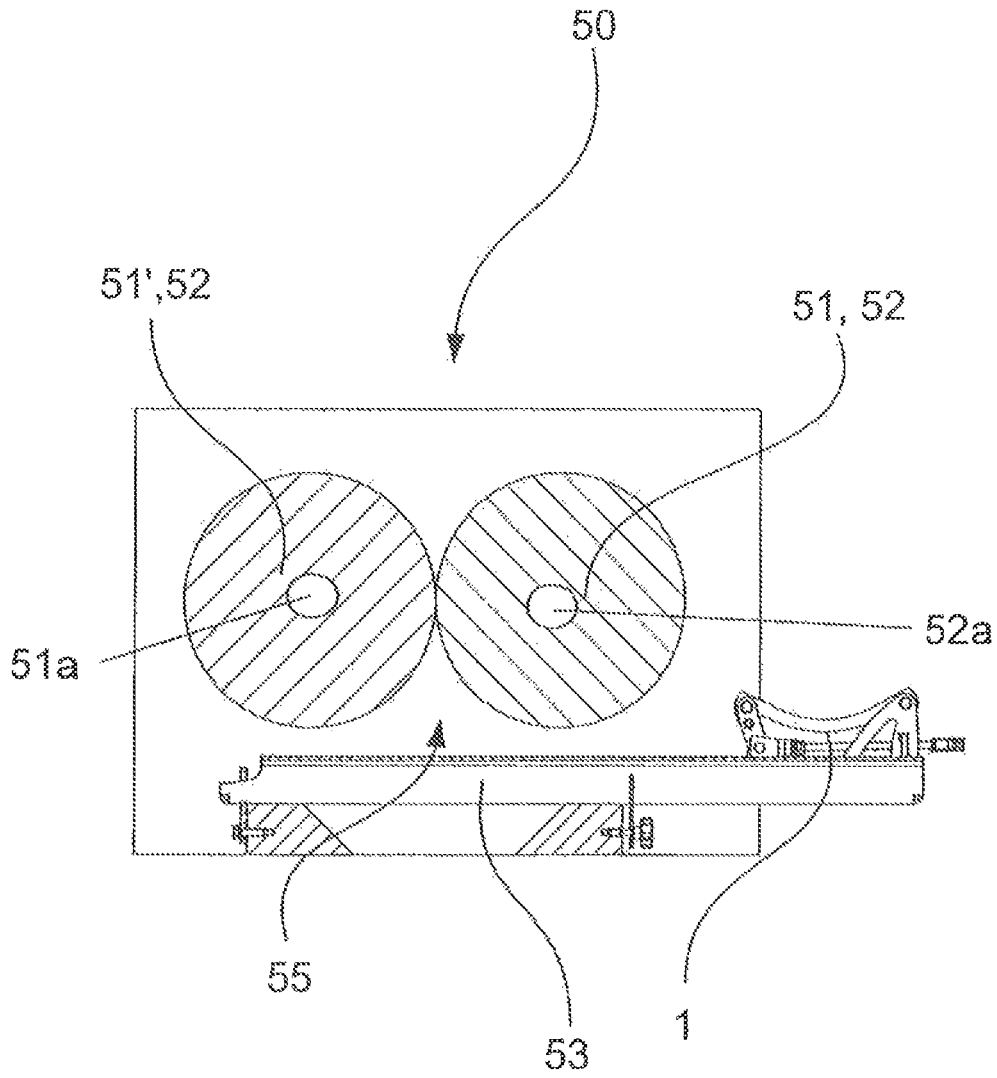
FIG. 6 a schematic, cross sectional side view of the roller mill of FIG. 5.

Beneath a respective end region of the roll body is situated a guide rail 53, which is designed to receive and guide a carrying device 1. In FIGS. 5 and 6, one carrying device 1 is arranged respectively on the guide rail 53.

The guide rail 53 and the carrying device 1 are coordinated with each other such that the carrying device 1 can only move along the guide rail in the direction perpendicular to the roll axis, apart from a tolerable sideways play. Moreover, the guide rails 53 are situated vertically to the rolls 51 and 51', so that upon releasing the roll body 52 it cannot roll out uncontrollably from the roller mill 50.

In order to remove the roll body 52 of the roll 51, a carrying device 1 is inserted into the corresponding guide rail 53 and situated underneath the roll body 52 in the product space 55. Of course, the receiving section 3 should be located in the introduction position E, or else the positioning of the carrying device 1 would not be possible. After the carrying device 1 has been arranged underneath the roll body 2, the receiving section 3 is raised into the supporting position S and then the roll body 52 is released by moving apart the roll stubs 51*a*, 52*a*. The roll body 52 can then be removed from the roller mill 50.

After the removal of the roll body 52 of the roll 51, the same can be done for the roll 51'.

The invention claimed is:

1. A roller body carrying device that is configured for use in frontal removal of a roller body from a roller mill, the roller body carrying device comprising:

a main frame comprising first and second spaced apart legs which each have a substantially L-shaped form, and a receiving section configured to receive the roller body, the receiving section is configured to be movable, relative to both the main frame and the roller body, between an introduction position and a supporting position, a first end of the receiving section being pivot-mounted, about a horizontal axis, to a first end region of the first and second spaced apart legs while an opposed second end of the receiving section being movable, relative to both the first and the second spaced apart legs, by actuating means for actuating the carrying device to facilitate moving the second end of the receiving section between the introduction position and the supporting position, and vice versa, the receiving section has a profile which, in the supporting position, at least partly encloses the roller body, with the receiving section moved into its introduction position by the actuating means for actuating the carrying device, the roller body carrying device is thereby configured to be capable of being inserted underneath the roller body and braced against a frame of the roller mill by guiding means which are removably arranged on the roller mill within a product space of the roller mill, which product space extends between a product pull-in area and a product exit area, and with the roller body carrying device positioned underneath the roller body and braced against the frame of the roller mill by the guiding means which are arranged on the roller mill within the product space of the roller mill and with the receiving section moved into its supporting position by the actuating means for actuating the roller body carrying device, the roller body is supported by the roller body carrying device.

2. The roller body carrying device according to claim 1, wherein one leg has additional guiding means.

3. The roller body carrying device according to claim 1 wherein the actuating means comprises a threaded rod.

4. The roller body carrying device according to claim 3, wherein the threaded rod is mounted in a threaded bushing, and the threaded bushing is mounted in a same leg of a substantially L-shaped main frame with two legs standing at an angle to each other as the receiving section.

5. The roller body carrying device according to claim 4, wherein the threaded rod is connected at one end to an expanding joint in a way that is rotatable, yet firm against pushing and pulling, the expanding joint is expandable by rotating of the threaded rod, and the receiving section can be moved from the introduction position into the supporting position.

6. The roller body carrying device according to claim 5, wherein the receiving section can be moved from the introduction position into the supporting position by increasing a distance between the threaded bushing and the end of the threaded rod which is connected to the expanding joint.

7. The roller body carrying device according to claim 3, wherein the threaded rod is provided with means for accommodating a drive unit that communicates with and rotationally drives the threaded rod.

8. The roller body carrying device according to claim 1, wherein means for limiting the movement of the receiving section are provided.

9. A roller mill with a plurality of rolls, wherein at least one roller comprises a roller body with two roll stubs, the roller body is releasable from the roller mill by moving the two roll stubs away from each other, wherein the guiding means for a roller body carrying device in accordance with claim 1 are removably arranged beneath the at least one roller within the product space of the roller mill such that the roller body carrying device can be braced against the frame of the roller mill by the guiding means such that the roller body can be removed frontally, and wherein the roller body carrying device is movable in a direction perpendicular to the roller axis.

10. The roller mill according to claim 9, wherein the guiding means enables a guiding of the roller body carrying device perpendicular to a plumb-line.

11. The roller mill according to claim 9, wherein the guiding means comprise at least one guide rail.

12. A method for a frontal removal of a roller body from a roller mill with a plurality of rollers, wherein at least one roller comprises a roller body with two roll stubs and the roller body is releasable by moving the two roll stubs away from each other, the method comprising:

introducing at least one roller body carrying device in accordance with claim 1;

lifting of the receiving section of the at least one roller body carrying device such that the roller body is in an operative connection with the roller body carrying device;

releasing of the roller body by moving the two roll stubs away from each other, so that the roller body is resting on the at least one roller body carrying device; and moving the at least one roller body carrying device perpendicularly to the roll axis.

13. The roller body carrying device according to claim 1, wherein joint segments couple the main frame, the receiving section and the actuating means to one another to facilitate moving the second end of the receiving section between the introduction position and the supporting position, and vice versa.

14. The roller body carrying device according to claim 13, wherein the joint segments and the actuating means are located between the main frame and the receiving section.

15. The roller body carrying device according to claim 13, wherein a first joint segment is connected to the actuating means, a second joint segment is connected to the main frame and a third joint segment is connected to the receiving section.

16. The roller body carrying device according to claim 1, wherein the actuating means is located vertically underneath the receiving section.

17. A roller body carrying device that is configured for use in frontal removal of a roller body from a roller mill, the roller body carrying device comprising:

a main frame comprising first and second spaced apart legs which each have a substantially L-shaped form, and a receiving section configured to receive the roller body, the receiving section is configured to be vertically movable, relative to both the main frame and the roller body, between an introduction position and a supporting position, a first end of the receiving section being pivot-mounted, about a horizontal axis, to a first end region of the first and second spaced apart legs while an opposed second end of the receiving section being movable, relative to both the first and the second spaced apart legs, by actuating means for actuating the carrying device to facilitate moving the second end of the receiving section between the introduction position and the supporting position, and vice versa, the roller body carrying device being laterally movable toward and away from a pair of rolling stubs which support the roller body, and the roller body carrying device, when in its supporting position supporting the roller body, facilitates laterally moving the roller body to a service position away from the pair of rolling stubs, the receiving section has a profile which, in the supporting position, at least partly encloses the roller body, with the receiving section moved into its introduction position by the actuating means for actuating the carrying device, the roller body carrying device is thereby configured to be capable of being inserted underneath the roller body and braced against a frame of the roller mill by guiding means which are removably arranged on the roller mill within a product space of the roller mill, which product space extends between a product pull-in area and a product exit area, and with the roller body carrying device positioned underneath the roller body and braced against the frame of the roller mill by the guiding means which are arranged on the roller mill within the product space of the roller mill and with the receiving section moved into its supporting position by the actuating means for actuating the roller body carrying device, the roller body is supported by the roller body carrying device.

* * * * *